US012022860B2

(12) United States Patent
Cao et al.

(10) Patent No.: US 12,022,860 B2
(45) Date of Patent: Jul. 2, 2024

(54) CELLULOSE ACETATE PARTICLE AGGREGATE, PREPARATION METHOD THEREFOR AND APPLICATION THEREOF

(71) Applicant: Nantong Cellulose Fibers Co., Ltd., Jiangsu (CN)

(72) Inventors: Jianguo Cao, Jiangsu (CN); Weijun Peng, Jiangsu (CN); Xiaomei Song, Jiangsu (CN); Jianfeng Xia, Jiangsu (CN)

(73) Assignee: Nantong Cellulose Fibers Co., Ltd., Nantong (CN)

( * ) Notice: Subject to any disclaimer, the term of this patent is extended or adjusted under 35 U.S.C. 154(b) by 655 days.

(21) Appl. No.: 17/121,890

(22) Filed: Dec. 15, 2020

(65) Prior Publication Data

US 2021/0092995 A1 Apr. 1, 2021

Related U.S. Application Data

(60) Division of application No. 15/652,351, filed on Jul. 18, 2017, now Pat. No. 10,893,701, which is a (Continued)

(30) Foreign Application Priority Data

Jan. 23, 2015 (CN) ..... 201510036109.5

(51) Int. Cl.
*A24D 3/10* (2006.01)
*A24C 5/52* (2006.01)
(Continued)

(52) U.S. Cl.
CPC ..... *A24D 3/10* (2013.01); *A24C 5/52* (2013.01); *A24D 3/02* (2013.01); *A24D 3/0229* (2013.01); *A24D 3/048* (2013.01)

(58) Field of Classification Search
None
See application file for complete search history.

(56) References Cited

U.S. PATENT DOCUMENTS 4,350,173 A 9/1982 Siren
6,541,627 B1 * 4/2003 Ono ..... C08J 3/09 536/124
(Continued)

FOREIGN PATENT DOCUMENTS

CN 102551208 A 7/2012
CN 102811631 A 12/2012
(Continued)

OTHER PUBLICATIONS

Osborne et al. "Binder addition methods and binder distribution in high shear and fluidised bed granulation", Chemical Engineering Research and Design, vol. 89, Issue 5, 2011, pp. 553-559 (Year: 2011).*
(Continued)

*Primary Examiner* — Katherine A Will
(74) *Attorney, Agent, or Firm* — Edell, Shapiro & Finnan, LLC

(57) ABSTRACT

A cellulose acetate particle aggregate, a preparation method therefor and an application thereof, which relate to the field of harm reduction additives in cigarettes. The cellulose acetate particle aggregate includes 49-99.5 wt % of cellulose acetate particles, 0-50 wt % of a second kind of particles, and 0.5-20 wt % of a binder. The preparation method involves selecting cellulose acetate particles and a second kind of particles in a certain ratio, or cellulose acetate particles alone, preparing particle aggregates by using an air fluidized granulation method while adding a binder thereto, and sieving the particle aggregates to obtain a cellulose acetate particle aggregate having a required particle size. The cellulose acetate particle aggregate has a porous struc-
(Continued)

ture, an irregular shape, and a rough and uneven surface, which help to improve the efficiency of filtering out particulate matters or one or more harmful ingredients in cigarette smoke.

9 Claims, 5 Drawing Sheets

Related U.S. Application Data continuation of application No. PCT/CN2016/071003, filed on Jan. 15, 2016.

(51) Int. Cl.
*A24D 3/02* (2006.01)
*A24D 3/04* (2006.01)

(56) References Cited

U.S. PATENT DOCUMENTS

2009/0186798 A1* 7/2009 Baston ..... C11D 3/3792
510/513
2012/0118309 A1 5/2012 Taniguchi

FOREIGN PATENT DOCUMENTS

CN 104705785 A 6/2015
JP H02222672 A 9/1990

OTHER PUBLICATIONS

Combined International Search Report and Written Opinion for PCT/CN2016/071003, dated Mar. 24, 2016, 8 pages.

* cited by examiner

CELLULOSE ACETATE PARTICLE AGGREGATE, PREPARATION METHOD THEREFOR AND APPLICATION THEREOF

CROSS REFERENCE TO RELATED APPLICATIONS

The present application is a divisional of U.S. patent application Ser. No. 15/652,351, filed Jul. 18, 2017, which is a continuation of International Application PCT/CN2016/071003, which has an international filing date of Jan. 15, 2016, and which claims priority to CN Patent Application No. 201510036109.5, filed Jan. 23, 2015, the disclosures of which are all hereby incorporated by reference in their entireties.

TECHNICAL FIELD

The present invention pertains to the field of cigarette harm reduction additives, and relates to a cellulose acetate particle aggregate, a preparation method therefor, and an application thereof.

BACKGROUND

As studies on the relationship between cigarette smoking and health deepens, it is becoming a common goal to increase the safety of cigarette smoking to ensure the survival and development of the tobacco industry. As shown by research, cigarette tar contains many ingredients harmful to human body. Meanwhile, researchers in the tobacco industry in China had selected seven (7) harmful constituents (carbon monoxide (CO), hydrogen cyanide, tobacco-specific nitrosamines (NNK), ammonia, benzo[α]pyrene, phenol, and croton aldehyde) from the Hoffman List to establish a cigarette mainstream smoke harm index. Therefore, focus in increasing safety of cigarette smoking has been to reduce tar in cigarette smoke, which contains substances harmful to health, and at the same time, to selectively reduce contents of the aforesaid seven harmful constituents.

In the 1950's, cigarettes tipped with cellulose acetate fiber tow filters were invented, which effectively reduced tar content in cigarettes. As the governments around the world are requiring further reducing the content of tar in cigarettes, enhancing filtering capability of cigarette filters has always been the focus of research in the tobacco industry. However, there is a limited space in further improving the filtering capability of cellulose acetate fiber tow filters.

SUMMARY

The first objective of the present invention is to provide a cellulose acetate particle aggregate which, when applied in filtering cigarette smoke, is capable of better filtering tar or one or more harmful substances in cigarette smoke.

The second objective of the present invention is to provide a preparation method for the cellulose acetate particle aggregate.

The third objective of the present invention is to provide an application of the cellulose acetate particle aggregate.

To achieve the aforesaid objectives, the present invention provides such solutions as follows:

Cellulose Acetate Particle Aggregate

A cellulose acetate particle aggregate comprises 49-99.5 wt % of cellulose acetate particles, 0-50 wt % of a second kind of particles and 0.5-20 wt % of a binder.

The second solution of the present disclosure is that the cellulose acetate particle aggregate may preferably comprise 60-99.5 wt % of the cellulose acetate particles, 0-35 wt % of the second kind of particles and 0.5-15 wt % of the binder, and may further preferably comprise 64-99 wt % of the cellulose acetate particles, 0-35 wt % of the second kind of particles and 0.5-15 wt % of the binder.

The third solution of the present disclosure is that the cellulose acetate particle aggregate may further preferably comprise 64-89 wt % of the cellulose acetate particles, 10-35 wt % of the second kind of particles and 0.5-15 wt % of the binder, and may further preferably comprise 64-79 wt % of the cellulose acetate particles, 20-30 wt % of the second kind of particles and 1-15 wt % of the binder, and may more preferably comprise 65-74 wt % of the cellulose acetate particles, 25-30 wt % of the second kind of particles and 1-10 wt % of the binder.

The fourth solution of the present disclosure is that the cellulose acetate particle aggregate may comprise 85-99.5 wt % of the cellulose acetate particles and 0.5-15 wt % of the binder.

The cellulose acetate particle aggregate of the present invention is irregular in shape and porous, with a rough and uneven surface. The cellulose acetate particle aggregate has an average particle size in a range of 150-850 μm, preferably in a range of 150-650 μm, and further preferably in a range of 150-425 μm; its pore size is in a range of 0.2-25 μm, preferably in a range of 0.4-20 μm; its specific surface area is in a range of 0.5-10 $m^2/g$, preferably in a range of 0.7-5 $m^2/g$; and its bulk density is in a range of 0.05-0.22 g/mL, preferably in a range of 0.07-0.20 g/mL;

wherein, the cellulose acetate particle has an average particle size in a range of 5-80 μm, preferably in a range of 10-70 μm;

the second kind of particles are prepared from one or more of substances selected from cellulose, methylcellulose, ethyl cellulose, propyl cellulose, methylethyl cellulose, and chitosan; and the binder is selected from one or more of starch, hydroxypropylmethylcellulose, hydroxyethyl methylcellulose, hydroxyethylethylcellulose, carboxymethylcellulose, methylcellulose, ethyl cellulose, propyl cellulose, methylethylcellulose, zein, guar gum, glycerol triacetate, triethyl citrate, triethylene glycol diacetate, alginate, gelatin, and dextrin.

[Preparation Method for the Cellulose Acetate Particle Aggregate]

A preparation method for the cellulose acetate particle aggregate, comprising steps of:

A. selecting cellulose acetate particles and second kind of particles in a certain ratio, or cellulose acetate particles alone;

B. adding a binder thereto to prepare particle aggregates by an air fluidized granulation method;

C. sieving the particle aggregates to obtain cellulose acetate particle aggregates in a desired size range.

In one embodiment, the aforesaid preparation method further comprises: grinding particle aggregates sieved out in Step C, which have particle sizes larger than the upper limit of the desired range, to be used in Step A.

In another embodiment, the aforesaid preparation method further comprises directly using in Step A the particle aggregates sieved out in Step C, which have particle sizes smaller than the lower limit of the desired range.

The aforesaid cellulose acetate particles may be prepared by two different methods: grinding of cellulose acetate flakes, or precipitation of cellulose acetate under basic conditions. The grinding of cellulose acetate flakes may be dry grinding or wet grinding.

Wet grinding includes steps of: grinding cellulose acetate flakes with water as a medium, and then centrifugal spray drying the resulting suspension of cellulose acetate particles in water, thereby obtaining the cellulose acetate particles. The cellulose acetate particles may have an average particle size of 5-80 μm.

The precipitation process includes steps of:

(1) dissolving the cellulose acetate (such as cellulose diacetate or cellulose triacetate) in an organic solvent to obtain a cellulose acetate solution of a certain concentration;

(2) with mechanical stirring at 250-450 rpm, adding an aqueous NaOH solution dropwise to the cellulose acetate solution to reduce the AV (acetyl value) and solubility of the cellulose acetate, so that the cellulose acetate is precipitated to obtain a white suspension;

(3) further stirring the suspension for a period of time to solidify the particles precipitated from the suspension;

(4) suction filtrating the suspension, washing with water and then centrifugal spray drying the filtered particles, thereby obtaining the cellulose acetate particles.

In the step (1) above, the acetyl value of the cellulose acetate is in the range of 40-62%, preferably in the range of 45-60%. The organic solvent is acetone, dimethyl sulfoxide, or a mixture thereof. If the organic solvent is a mixture of acetone and dimethyl sulfoxide, the mass ratio of acetone to dimethyl sulfoxide is (1-4):1. The content of cellulose acetate in the cellulose acetate solution is 1-20 wt %.

In the step (2), the aqueous NaOH solution has a concentration of 0.05-1.0 mol/L, preferably 0.1-1.0 mol/L. The aqueous NaOH solution is added in such an amount that the ratio by mass of NaOH solute to cellulose acetate is (1-50):100.

The solubility of cellulose acetate may be further reduced by rotary evaporation of the organic solvent (such as acetone) or by further addition of deionized water.

In the step (4), the resulting cellulose acetate particles may have an average particle size of 5-80 μm.

The air fluidized granulation method in the step B includes steps of: stirring the binder in a solvent to prepare a binder spray liquid (solution or suspension), atomizing and spraying the binder spray liquid, maintaining the cellulose acetate particles and the second kind of particles or only the cellulose acetate particles in a fluidized state in the fluidized bed by feeding air from the bottom to contact with the binder spray liquid and being bind together, and then drying the resultant to obtain the particle aggregate.

The aforesaid preparation method may be of continuous or intermittent type. In the case of the continuous preparation method, while the binder spray liquid is sprayed from the top, the initial granulation particles (such as the cellulose acetate particles and the second kind of particles, or the cellulose acetate particles alone) are fed continuously from a feed inlet. The granulated particle aggregates are automatically discharged from an outlet. After sieving, the aggregates with particle sizes smaller than the lower limit of the desired range are fed back to the feed inlet, while those with particle sizes larger than the upper limit of the desired range of particle size are ground and then fed back to the feed inlet. A continuous fluidized bed GF of German GLAT, for example, can meet such technical requirements.

The solvent used in the air fluidized granulation method is selected from one or more of water, ethanol, propanol, and acetone. The content of the binder in the binder spray liquid is 2-15 wt %.

In the air fluidized granulation process, the atomization pressure is in a range of 50-120 bar, and the spray flow rate of the binder spray liquid is in a range of 10-30 g/min, air feeding rate from the bottom is in a range of 20-80 $m^3$/hr, and the inlet temperature of air from the bottom is in a range of 20–55° C.

Application of the Cellulose Acetate Particle Aggregates

An application of the cellulose acetate particle aggregate in preparing a composite filter or a cigarette with a composite filter, including:

A. combing a certain amount of the cellulose acetate particle aggregates with a cellulose diacetate tow filter rod to obtain a composite filter; or B. joining the composite filter from the step A to a cigarette to prepare a cigarette with the composite filter.

In one embodiment, in a process of preparing a cellulose diacetate tow filter rod, the cellulose acetate particle aggregate is added to an opened fiber tow to provide filter rod with the cellulose acetate aggregate wrapped in the cellulose diacetate tow, and the resulting cellulose acetate particle aggregate filter rod is then combined with a cellulose diacetate tow filter rod to obtain the composite filter.

The cellulose acetate particle aggregate may be added to a cavity between two sections of cellulose diacetate tow filter rod to form a 3-section composite filter. Alternatively, the cellulose acetate particle aggregate may be added to a cavity between a section of cellulose diacetate tow filter rod and a section of filter rod of another material to form a 3-section composite filter. The cellulose acetate particle aggregate is added at an amount of 10-60 mg/cigarette.

Due to the aforesaid solutions, the present invention has the following beneficial effects:

The cellulose acetate particle aggregate of the present invention includes at least cellulose acetate particles and a binder. As compared with currently common cellulose acetate fiber tow, the composition of the cellulose acetate particle aggregate of the present invention and its physical form of having porous structure, irregular shape, and rough and uneven surface contribute to increasing the efficiency of filtering out particulate matters or one or more harmful ingredients in cigarette smoke.

When the cellulose acetate particle aggregate is used as a filtering material, a composite filter made from the cellulose acetate particle aggregate and a cellulose acetate filter rod in combination can effectively reduce the content of tar in cigarette smoke, or can be highly adsorptive for one or more harmful ingredients in cigarette smoke, such as phenol, croton aldehyde, hydrocyanic acid, ammonia, benzo[α] pyrene, and nitrosamine.

DETAILED DESCRIPTION

Figure 1:
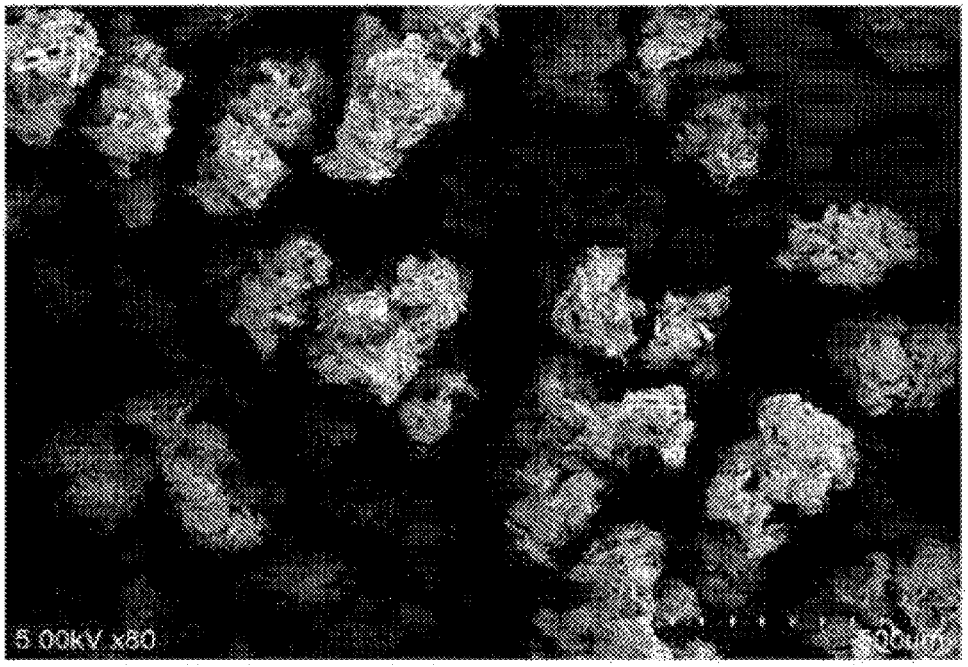
FIG. 1 is an electron micrograph of a cellulose acetate particle aggregate of Example 1 of the present invention.

The present invention provides a cellulose acetate particle aggregate, a preparation method thereof, and an application thereof.

Cellulose Acetate Particle Aggregate

A cellulose acetate particle aggregate, including 49-99.5 wt % of cellulose acetate particles, 0-50 wt % of a second kind of particles and 0.5-20 wt % of a binder.

In one embodiment, the cellulose acetate particle aggregate may preferably include 60-99.5 wt % of the cellulose acetate particles, 0-35 wt % of the second kind of particles and 0.5-15 wt % of the binder, and may further preferably include 64-99 wt % of the cellulose acetate particles, 0-35 wt % of the second kind of particles and 0.5-15 wt % of the binder, and may more preferably include 85-99 wt % of the cellulose acetate particles and 1-15 wt % of the binder.

In another embodiment, the cellulose acetate particle aggregate may preferably include 64-89 wt % of the cellulose acetate particles, 10-35 wt % of the second kind of particles and 0.5-15 wt % of the binder, and may further preferably include 64-79 wt % of the cellulose acetate particles, 20-30 wt % of the second kind of particles and 1-15 wt % of the binder, and may more preferably include 65-74 wt % of the cellulose acetate particles, 25-30 wt % of the second kind of particles and 1-10 wt % of the binder.

The cellulose acetate particles and the second kind of particles are randomly stacked together and bound together by the binder into the cellulose acetate particle aggregate, or the cellulose acetate particles randomly stacked together and bound together by the binder into the cellulose acetate particle aggregate.

Cellulose Acetate Particles

The cellulose acetate particles have an average particle size in a range of 5-80 μm, preferably in a range of 10-70 μm.

The cellulose acetate particles may be prepared by two different methods below, that is, grinding of cellulose acetate flakes or precipitation under basic conditions.

(1) Grinding of Cellulose Acetate Flakes:

Cellulose acetate flakes are ground with water as a medium, and then the resulting suspension of cellulose acetate particles in water is dried through centrifugal spray, thereby obtaining the cellulose acetate particles. The resulting cellulose acetate particles have an average particle size of 5-80 μm, preferably 10-70 μm.

For this method, either dry grinding or wet grinding is suitable. In wet grinding, the cellulose acetate flakes are ground in a basket-type grinder with water as the medium.

(2) Precipitation Under Basic Conditions:

A. Dissolving cellulose acetate in an organic solvent to obtain a cellulose acetate solution of a certain concentration;

B. With mechanical stirring at 250-450 rpm, adding an aqueous NaOH solution dropwise to the cellulose acetate solution so that cellulose acetate is precipitated to obtain a white suspension;

C. Further stirring the suspension for a period of time to solidify the particles precipitated from the suspension;

D. Suction filtrating the suspension, washing the filtered particles with water and then drying the particles by centrifugal spray, thereby obtaining the cellulose acetate particles.

In the step A of the method (2), the cellulose acetate is cellulose diacetate or cellulose triacetate with an acetyl value of 40-62%, preferably 45-60%. The organic solvent is acetone, dimethyl sulfoxide, or a mixture of thereof. If the organic solvent is a mixture of acetone and dimethyl sulfoxide, the mass ratio of acetone to dimethyl sulfoxide is (1-4):1. The content of cellulose acetate in the cellulose acetate solution is 1-20 wt %.

In the steps B and C, the aqueous NaOH solution is added for the purpose of reducing the acetyl value (AV) and solubility of cellulose acetate. The aqueous NaOH solution has a concentration range of 0.05-1.0 mol/L, preferably 0.1-1.0 mol/L. The ratio by mass of NaOH solute to cellulose acetate is (1-50):100.

In this step, the solubility of cellulose acetate may be further reduced by vacuum rotary evaporation of the organic solvent (such as acetone) or by further addition of deionized water, so that cellulose acetate is further precipitated, thereby obtaining the desired cellulose acetate suspension. The vacuum rotary evaporation is implemented at a temperature of 40-60° C. and a vacuum degree of 260-180 mbar. The ratio by mass of acetone to deionized water is (2-1):(1-3).

In the step D, the resulting cellulose acetate particles have an average particle size of 5-80 μm, preferably 10-70 μm.

Second Kind of Particles

The second kind of particles are prepared from one or more of substances selected from cellulose, methylcellulose, ethyl cellulose, propyl cellulose, methylethylcellulose, and chitosan. The second kind of particles have an average particle size of 40-50 μm.

The second kind of particles may be commercially available or prepared according to the preparation method for cellulose acetate particles.

Binder

The binder is selected from any one or more of starch, hydroxypropylmethylcellulose, hydroxyethyl methylcellulose, hydroxyethylethylcellulose, carboxymethylcellulose, methylcellulose, ethyl cellulose, propyl cellulose, methylethylcellulose, zein, guar gum, glycerol triacetate, triethyl citrate, triethylene glycol diacetate, alginate, gelatin, and dextrin.

Preparation Method for Cellulose Acetate Particle Aggregate

A preparation method for the cellulose acetate particle aggregate includes steps of:

A. selecting the cellulose acetate particles and the second kind of particles in a certain ratio, or the cellulose acetate particles alone;

B. adding a binder thereto to prepare particle aggregates by an air fluidized granulation method;

C. sieving the particle aggregates obtained in the step B to obtain a cellulose acetate particle aggregate with the desired particle size.

In the step A, the selected cellulose acetate particles have an average particle size in a range of 5-80 μm, preferably in a range of 10-70 μm.

In the step B, the air fluidized granulation method includes steps of: stirring the binder in a solvent to prepare an binder spray liquid (solution or suspension), atomizing and spraying the binder spray liquid, maintaining the cellulose acetate particles and the second kind of particles or the cellulose acetate particles alone in a fluidized state in the fluidized bed by feeding air from the bottom to contact and bind with the binder spray liquid, and then drying the resultant to obtain the particle aggregate. The mass of the binder is 2-15% of the total mass of the binder spray liquid.

The solvent used in the air fluidized granulation method is selected from one or more of water, ethanol, propanol, and acetone. The atomization pressure is in a range of 50-120 bar, and the spray flow rate of the binder spray liquid is in a range of 10-30 g/min. The supply rate of air from the bottom is in a range of 20-80 $m^3$/hr, and the temperature of air fed from the bottom (inlet temperature) is in a range of 20–55° C.

In the step C, as a result of its preparation method and production mechanism, the cellulose acetate particle aggregate is irregular and porous, with rough and uneven surfaces. The cellulose acetate particle aggregate has a particle size in a range of 150-850 μm, preferably 150-650 μm, and more preferably 150-425 μm; its specific surface area is in a range of 0.5-10 $m^2$/g, preferably 0.7-5 $m^2$/g; its pore size is in a range of 0.2-25 μm, preferably 0.4-20 μm; and its bulk density is in a range of 0.05-0.22 g/mL, preferably 0.07-0.20 g/mL.

The aforesaid preparation method for the cellulose acetate particle aggregate may further include the following steps:

D. Grinding the particle aggregates sieved out from the step C for having particle sizes larger than the upper limit of the desired range of particle size to be used in the step A, and/or.

E. Directly using the particle aggregates sieved out having a particle size smaller than the lower limit of the desired range of particle size in the step A.

The aforesaid preparation method for the cellulose acetate particle aggregate may be of continuous or batch type.

Application of Cellulose Acetate Particle Aggregate

An application of the cellulose acetate particle aggregate includes:

A. Combining a certain amount of the cellulose acetate particle aggregate with a cellulose diacetate tow filter rod to obtain a composite filter; or B. Joining the composite filter from the step A to a cigarette to prepare a cigarette with a composite filter.

In the application A, in a process of preparing the cellulose diacetate tow filter rod, the cellulose acetate particle aggregate is added onto opened fiber tow to make a composite filter rod of a cellulose acetate aggregate wrapped by the cellulose diacetate tow, and the resulting filter rod is then combined with the cellulose diacetate tow filter rod to obtain the composite filter.

In the application B, the cellulose acetate particle aggregate may be added to a cavity between two sections of cellulose diacetate tow filter rod to form a 3-section composite filter. Alternatively, the cellulose acetate particle aggregate may be added to a cavity between a section of cellulose diacetate tow filter rod and a section of filter rod of another material to form a 3-section composite filter. For example, the cellulose acetate particle aggregate may be introduced at an amount of 10-60 mg/cigarette in the cellulose diacetate tow filter rod to obtain a three-section composite filter.

Irregular channels are formed between cellulose acetate particle aggregates or between the cellulose acetate particle aggregates and other filter materials when the cellulose acetate particle aggregate is used as a filtering material due to its porous and irregular physical form with a rough and uneven surface and selected ranges of particle size, specific surface area, pore size and bulk density. Therefore, the composite filter composed of the cellulose acetate particle aggregate and the cellulose acetate filter rod can effectively reduce the content of tar in cigarette smoke and efficiently adsorb phenol, croton aldehyde, hydrocyanic acid, ammonia, benzo[α]pyrene, and nitrosamine in cigarette smoke.

The present invention will be further described in conjunction with examples.

In the examples below, both of the cellulose acetate particles and the cellulose acetate particle aggregate were tested for their specific surface area by the nitrogen adsorption multi-point BET method using an ASAP2020 automatic fast specific surface area and mesopore/micropore analyzer of the MICROMERITICS INSTRUMENT CORP.

Cigarette smoke puff and inhalation test: On a conventional SM450 cigarette smoking machine for analysis, cigarette mainstream smoke was tested for total particulate matters (TPMs) and tar according to GB/T 19609-2004; for nicotine in the TPMs according to YC/T156-2001; for carbon monoxide (CO) in the smoke phase according to YC/T30 non-dispersive infra-red method; for phenol and croton aldehyde according to YC/T255-2008 and YC/T254-2008 high performance liquid chromatography (HPLC) respectively; for hydrogen cyanide (HCN) according to YC/T253-2008 continuous flow phase method; for ammonia (NH3) according to YC/T 377-2010 using an ICS5000 ion chromatograph; for nitrosamines (such as nitrosamine ketone (NNK)) using LC-MS (Agilent1290-6460); and for benzo[α]pyrene (B[α]P) according to GB/T 21130-2007 pretreatment method using HPLC-UV. For all the tests, parallel puff and inhalation was conducted in at least 4 channels, with the mean deviation of the parallel data being no more than 10%.

Example 1

(1) Commercially available cellulose diacetate flakes with an acetyl value of 55.50% were ground in a basket-type grinder with water as a medium. The suspension of ground cellulose diacetate in water was dried by centrifugal spray, thereby obtaining cellulose diacetate particles with an average particle size of 50 μm, a specific surface area of 5.2 $m^2$/g, and a bulk density of 0.22 g/mL.

(2) An amount of 250 g of the aforesaid spray-dried cellulose diacetate particles was weighed, placed into a spray fluidized bed. A binder spray liquid was prepared using water as a medium (equivalent to a solvent) with 4 wt % of starch (i.e., the mass of the binder liquid makes up 4% of the total mass of the binder and solvent). An amount of 320 g of the binder spray liquid was sprayed from the top under fluidization conditions including an atomization pressure of 60 bar, a spray liquid flow rate of 20 g/min, an air supply rate of 40 $m^3$/h, and an inlet temperature of 50° C. After the binder was applied, the fluidized bed was maintained at an air inlet temperature of 60° C. with an air supply rate of 30 $m^3$/h for 15 minutes.

Figure 2:
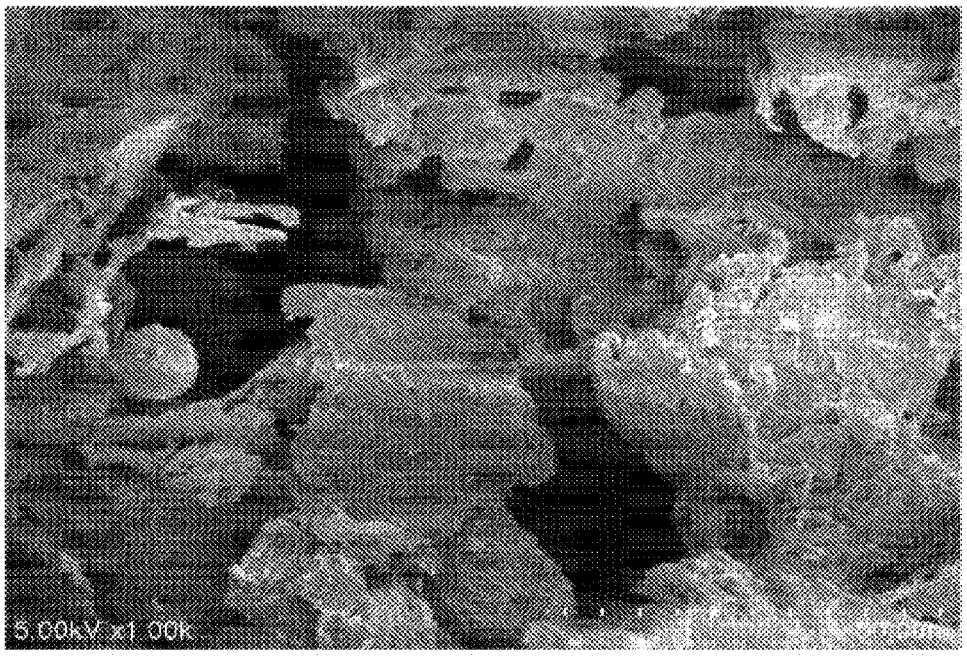
FIG. 2 is another electron micrograph of the cellulose acetate particle aggregate of Example 1 of the present invention.

(3) After the granulation was completed, the finished products (i.e., particle aggregates) were sieved, thereby obtaining a sample of 150-425 μm (i.e., cellulose acetate particle aggregate). As analyzed by an electron microscope, the cellulose acetate particle aggregate is porous and irregular with a rough and uneven surface (as shown in FIG. 1 and FIG. 2), having a pore size of 2-10 μm, a specific surface area of 3.2 $m^2$/g, and a bulk density of 0.12 g/mL.

Using the aforesaid cellulose acetate particle aggregate as an additive for a composite filter at an amount of 60 mg/cig (i.e., 60 mg per cigarette), a composite filter rod was made.

The composite filter rod is composed of two sections of cellulose diacetate tow filters, of which, one was to be in contact with a smoker's mouth and the other joined with a cigarette, and the particle aggregate disposed there between. With a cigarette without any modification materials as a control sample, smoking tests were conducted in a cigarette smoking machine under standard smoking conditions, and constituents in cigarette mainstream smoke were tested according to related test standards, and the results are shown in Table 1 and Table 2.

TABLE 1

Performance evaluation of cigarette sample including porous cellulose acetate particle aggregate

| | Pressure drop, kPa | TPM, mg | Tar, mg | Nicotine, mg |
|---|---|---|---|---|
| Control sample | 1.20 | 8.95 | 7.68 | 0.64 |
| Sample including particle aggregate | 1.25 | 6.24 | 5.50 | 0.45 |
| Reduction percentage, % | | 30.3 | 28.4 | 29.7 |

TABLE 2

Routine analysis results of cigarette smoke per cigarette

| | Harmful substances | | | | | | | |
|---|---|---|---|---|---|---|---|---|
| Unit | CO mg | HCN μg | NNK ng | $NH_3$ μg | B[α]P ng | Phenol μg | Croton-aldehyde μg | Harm indices |
| Xi(2009 Ave) | 14.20 | 146.30 | 5.50 | 8.10 | 10.90 | 17.40 | 18.60 | 10.00 |
| Control sample | 8.94 | 83.06 | 5.49 | 5.08 | 5.41 | 12.03 | 16.06 | 6.97 |
| Sample including particle aggregate | 8.51 | 63.17 | 4.73 | 4.08 | 4.01 | 6.70 | 12.59 | 5.46 |

Example 2

(1) Cellulose diacetate particles with an average particle size of 50 μm, a specific surface area of 5.2 $m^2/g$, a bulk density of 0.22 g/mL and an acetyl value of 55.50% were prepared according to the same method as in Example 1.

(2) Amounts of 220 g of the aforesaid spray-dried cellulose diacetate particles and 110 g of microcrystalline cellulose powder (average particle size, 50 μm) were weighed, and placed into a spray fluidized bed, where they were maintained at an air temperature of 50° C. and an air supply rate of 40 $m^3/h$ for 2 minutes, such that the cellulose diacetate and microcrystalline cellulose were thoroughly mixed. With starch as a binder and water as a medium, the mixture was formulated into a binder spray liquid containing 4 wt % of starch. An amount of 770 g of the binder spray liquid was sprayed from the top under fluidization conditions including an atomization pressure of 60 bar, a spray liquid flow rate of 20 g/min, an air supply rate of 40 $m^3/h$, and an inlet temperature of 50° C. After the binder was applied, the fluidized bed was maintained at an air inlet temperature of 60° C. with an air supply rate of 30 $m^3/h$ for 15 minutes.

(3) After the granulation was completed, the finished products were sieved, thereby obtaining a sample of 150-425 μm (i.e., cellulose acetate particle aggregate). As analyzed by an electron microscope, the particle aggregate is porous and irregular, with a rough and uneven surface, having a pore size of 2-15 μm, a specific surface area of 3.6 $m^2/g$, and a bulk density of 0.13 g/mL.

Using the aforesaid cellulose acetate particle aggregate as a filtering material, a composite filter was made. The composite filter was composed of two sections of cellulose diacetate tow rods, of which, one was to be in contact with a smoker's mouth and the other joined with a cigarette, and the cellulose acetate particle aggregate (60 mg) was disposed therebetween. With a cigarette having a cellulose diacetate tow filter as a control sample, smoking tests were conducted in a cigarette smoking machine under standard smoking conditions, and constituents in cigarette mainstream smoke were tested according to related test standards, and the results are shown in Table 3.

TABLE 3

Performance evaluation of cigarette sample including cellulose diacetate particle aggregate

| | Pressure drop, kPa | TPM, mg |
|---|---|---|
| Control sample | 1.18 | 15.21 |
| Sample including particle aggregate | 1.20 | 12.17 |
| Reduction percentage, % | | 20.0 |

Example 3

(1) Commercially available cellulose diacetate flakes with an acetyl value of 55.50% were ground in a basket-type grinder with water as a medium. The suspension of ground cellulose diacetate in water was dried by centrifugal spray, thereby obtaining cellulose diacetate particles with an average particle size of 20 μm, a specific surface area of 5.6 $m^2/g$, and a bulk density of 0.23 g/mL.

(2) An amount of 250 g of the aforesaid spray-dried cellulose diacetate particles was weighed, placed into a spray fluidized bed. A binder spray liquid was prepared using water as a medium (equivalent to a solvent) with 4 wt % of starch (i.e., the mass of the binder liquid makes up 4% of the total mass of the binder and solvent). The binder spray liquid (310 g) was sprayed from the top under fluidization conditions including an atomization pressure of 60 bar, a spray liquid flow rate of 20 g/min, an air supply rate of 40 $m^3$/h, and an inlet temperature of 50° C. After the binder was applied, the resultant was maintained at an air inlet temperature of 60° C. with an air supply rate of 30 $m^3$/h for 15 minutes.

(3) After the granulation was completed, the finished products were sieved, thereby obtaining a sample of 150-425 μm (i.e., cellulose acetate particle aggregate). As analyzed by an electron microscope, the cellulose acetate particle aggregate is porous and irregular, with a rough and uneven surface, having a pore size of 0.5-5 μm, a specific surface area of 2.6 $m^2$/g, and a bulk density of 0.18 g/mL.

A composite filter for cigarette was prepared using the aforesaid cellulose acetate particle aggregate as a filtering material. The composite filter was composed of two sections of cellulose diacetate tow rods, of which, one was to be in contact with a smoker's mouth and the other joined with a cigarette, and the cellulose acetate particle aggregate (30 mg) was disposed therebetween. With a cigarette having a filter composed of cellulose diacetate tow as a control sample, smoking tests were conducted in a cigarette smoking machine under standard smoking conditions, and the cigarette mainstream smoke was tested for its ingredients according to related test standards, and the results are shown in Table 4.

TABLE 4

Performance evaluation of cigarette sample including cellulose diacetate particle aggregate

| | Pressure drop, kPa | TPM, mg | Tar, mg | Nicotine, mg | CO, mg |
|---|---|---|---|---|---|
| Control sample | 1.20 | 9.11 | 7.77 | 0.65 | 9.14 |
| Sample including particle aggregate | 1.30 | 7.94 | 6.69 | 0.58 | 8.92 |
| Reduction percentage, % | | 12.8 | 13.9 | 10.8 | 2.4 |

Example 4

(1) Commercially available cellulose diacetate flakes with an acetyl value of 55.50% were ground in a drying grinder, thereby obtaining cellulose diacetate particles with an average particle size of 50 μm, a specific surface area of 5.1 $m^2$/g, and a bulk density of 0.20 g/mL.

(2) An amount of 250 g of the aforesaid spray-dried cellulose diacetate particles was weighed, placed into a spray fluidized bed. A binder spray liquid was prepared using water as a medium with 4 wt % of starch. Amount of 429 g of the binder spray liquid was sprayed from the top under fluidization conditions including an atomization pressure of 60 bar, a spray liquid flow rate of 20 g/min, an air supply rate of 40 $m^3$/h, and an inlet temperature of 50° C. After the binder was applied, the resultant was maintained at an air inlet temperature of 60° C. with an air supply rate of 30 $m^3$/h for 15 minutes.

(3) After the granulation was completed, the finished products were sieved, thereby obtaining a sample of 150-425 μm (i.e., cellulose acetate particle aggregate). As analyzed by an electron microscope, the cellulose acetate particle aggregate is porous and irregular, with a rough and uneven surface, having a pore size of 2-15 μm, a specific surface area of 1.9 $m^2$/g, and a bulk density of 0.11 g/mL.

A composite filter for cigarette was prepared using the aforesaid cellulose acetate particle aggregate as a filtering material. The composite filter was composed of two sections of cellulose diacetate tow rods, of which, one was to be in contact with a smoker's mouth and the other joined with a cigarette, and the cellulose acetate particle aggregate (60 mg) was disposed therebetween. With a cigarette having a filter composed of cellulose diacetate tow as a control sample, smoking tests were conducted in a cigarette smoking machine under standard smoking conditions, and constituents in cigarette mainstream smoke were tested according to related test standards, and the results are shown in Table 5.

TABLE 5

Performance evaluation of cigarette sample including cellulose diacetate particle aggregate

| | Pressure drop, kPa | TPM, mg | Tar, mg | Nicotine, mg | CO, mg |
|---|---|---|---|---|---|
| Control sample | 1.18 | 8.82 | 7.56 | 0.63 | 8.78 |
| Sample including particle aggregate | 1.20 | 6.52 | 5.82 | 0.50 | 8.46 |
| Reduction percentage, % | | 26.1 | 23.0 | 20.6 | 3.6 |

Example 5

(1) Commercially available cellulose diacetate flakes with an acetyl value of 55.50% were ground in a freeze drying grinder, thereby obtaining cellulose diacetate particles with an average particle size of 51 μm, a specific surface area of 5.1 $m^2$/g, and a bulk density of 0.19 g/mL.

(2) An amount of 250 g of the aforesaid spray-dried cellulose diacetate particles was weighed, placed into a spray fluidized bed. A binder spray liquid was prepared using water as a medium with 4 wt % of starch. An amount of 365 g of the binder spray liquid was sprayed from the top under fluidization conditions including an atomization pressure of 60 bar, a spray liquid flow rate of 20 g/min, an air supply rate of 40 $m^3$/h, and an inlet temperature of 50° C. After the binder was applied, the resultant was maintained at an air inlet temperature of 60° C. with an air supply rate of 30 $m^3$/h for 15 minutes.

(3) After the granulation was completed, the finished products were sieved, thereby obtaining a sample of 150-425 μm (i.e., cellulose acetate particle aggregate). As analyzed by an electron microscope, the cellulose acetate particle aggregate is porous and irregular, with a rough and uneven surface, having a pore size of 2-20 μm, a specific surface area of 2.5 $m^2$/g, and a bulk density of 0.15 g/mL.

A composite filter for cigarette was prepared using the aforesaid cellulose acetate particle aggregate as a filtering material. The composite filter was composed of two sections of cellulose diacetate tow rods, of which, one was to be in contact with a smoker's mouth and the other joined with a cigarette, and the cellulose acetate particle aggregate (60 mg) was disposed therebetween. With a cigarette having a filter composed of cellulose diacetate tow as a control sample, smoking tests were conducted in a cigarette smoking machine under standard smoking conditions, and constituents in cigarette mainstream smoke were tested according to related test standards, and the results are shown in Table 6.

TABLE 6

Performance evaluation of cigarette sample including cellulose diacetate particle aggregate

| | Pressure drop, kPa | TPM, mg |
|---|---|---|
| Control sample | 1.20 | 8.85 |
| Sample including particle aggregate | 1.20 | 7.66 |
| Reduction percentage, % | | 13.5 |

Example 6

(1) Commercially available cellulose diacetate flakes with an acetyl value of 55.50% were ground in a basket-type grinder with water as a medium. The suspension of ground cellulose diacetate in water was dried through spray configuration, thereby obtaining cellulose diacetate particles with an average particle size of 50 μm, a specific surface area of 5.2 $m^2$/g, and a bulk density of 0.22 g/mL.

(2) An amount of 250 g of the aforesaid spray-dried cellulose diacetate particles were weighed, and placed into a spray fluidized bed. A binder spray liquid was prepared containing 0.5 wt % carboxymethylcellulose as a binder in water An amount of 487 g of the binder spray liquid was sprayed from the top under fluidization conditions including an atomization pressure of 60 bar, a spray liquid flow rate of 20 g/min, an air supply rate of 40 $m^3$/h, and an inlet temperature of 50° C. After the binder was applied, the resultant was maintained at an air inlet temperature of 60° C. with an air supply rate of 30 $m^3$/h for 15 minutes.

(3) After the granulation was completed, the finished products were sieved, thereby obtaining a sample of 150-425 μm (i.e., cellulose acetate particle aggregate). As analyzed by an electron microscope, the cellulose acetate particle aggregate is porous and irregular, with a rough and uneven surface, having a pore size of 2-15 μm, a specific surface area of 4.1 $m^2$/g, and a bulk density of 0.11 g/mL.

A composite filter for cigarette was prepared using the aforesaid cellulose acetate particle aggregate as a filtering material. The composite filter was composed of two sections of cellulose diacetate tow rods, of which, one was to be in contact with a smoker's mouth and the other joined with a cigarette, and the cellulose acetate particle aggregate (60 mg) was disposed therebetween. With a cigarette having a filter composed of cellulose diacetate tow as a control sample, smoking tests were conducted in a cigarette smoking machine under standard smoking conditions, and constituents in cigarette mainstream smoke were tested according to related test standards, and the results are shown in Table 7.

TABLE 7

Performance evaluation of cigarette sample including cellulose diacetate particle aggregate

| | Pressure drop, kPa | TPM, mg |
|---|---|---|
| Control sample | 1.20 | 8.86 |
| Sample including particle aggregate | 1.22 | 6.65 |
| Reduction percentage, % | | 26.5 |

Example 7

(1) Commercially available cellulose diacetate flakes with an acetyl value of 55.50% were dissolved in acetone as a solvent, thereby obtaining a homogenous 7.5 wt % cellulose diacetate solution in acetone. With mechanical stirring (250-450 rpm), a 0.2 mol/L ([M]) aqueous NaOH solution (the mass of NaOH is 5.1% of the mass of cellulose diacetate) was added dropwise thereto. As the NaOH solution was added, the cellulose acetate in the solution began to precipitate. Then, an appropriate amount of deionized water was added thereto to facilitate solidifying of the precipitated cellulose acetate particles. After continuous stirring for about 2 h, the resultant was suction filtered, washed with deionized water and then spray dried, thereby obtaining white cellulose acetate particles with an average particle size of 20 μm, an acetyl value (AV) of 49.9%, a specific surface area of 3.9 $m^3$/g, an average pore size (BJH adsorption) of 8.6 nm and a bulk density of 0.37 g/mL.

(2) An amount of 250 g of the aforesaid cellulose diacetate particles obtained by the above precipitation method was weighed, and placed into a spray fluidized bed. A binder spray liquid was prepared using water as a medium with 4 wt % of starch as the binder. An amount of 900 g of the binder spray liquid was sprayed from the top for fluidized granulation under fluidization conditions including an atomization pressure of 60 bar, a spray liquid flow rate of 17 g/min, an air supply rate of 55 $m^3$/h, and an inlet temperature of 55° C. The binder was used inane amount of 14.4% of the mass of the cellulose diacetate particles (i.e., starch is 36 g). After the binder was applied, the fluidized bed was maintained at an air inlet temperature of 60° C. with an air supply rate of 30 $m^3$/h for 15 minutes.

Figure 3:
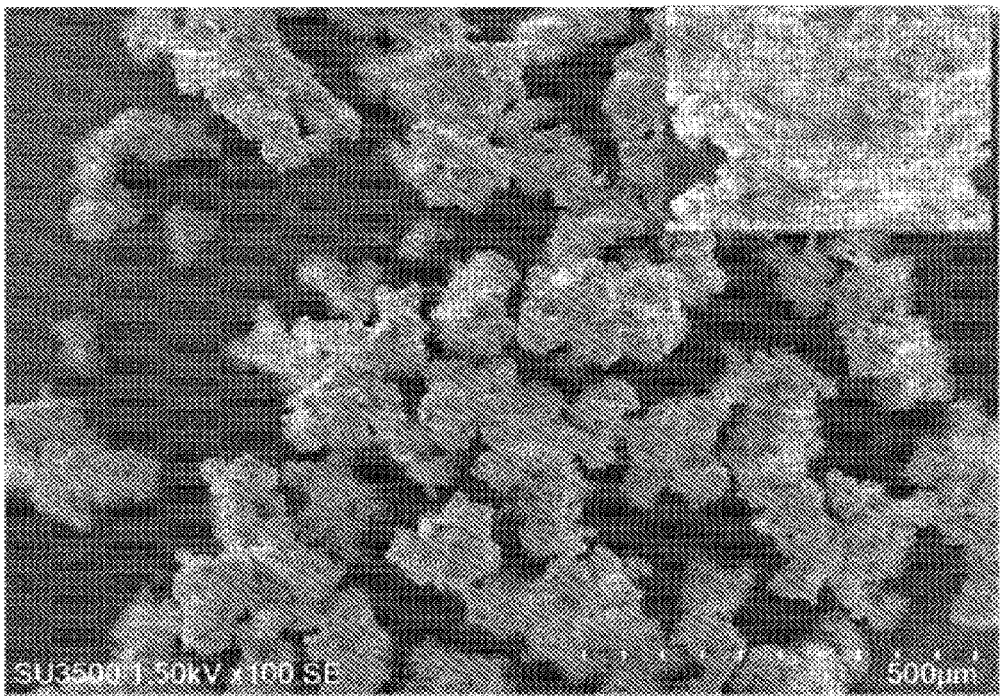
FIG. 3 is an electron micrograph of a cellulose acetate particle aggregate of Example 7 of the present invention.

(3) After the granulation was completed, the finished products were sieved, thereby obtaining a sample of 150-425 μm (i.e., cellulose acetate particle aggregate). As analyzed by an electron microscope, the cellulose acetate particle aggregate was a porous and irregular particle aggregate with a rough and uneven surface formed from spherical particles bound together by the binder (as shown in FIG. 3). The particle aggregate has a specific surface area of 1.3 $m^2$/g, an average pore size (BJH adsorption) of 10.3 nm and a bulk density of 0.17 g/mL.

A composite filter for cigarette was prepared using the aforesaid cellulose acetate particle aggregate as a filtering material. The composite filter was composed of two sections of cellulose diacetate tow rods, of which, one was to be in contact with a smoker's mouth and the other joined with a cigarette, and the cellulose acetate particle aggregate (60 mg) was disposed therebetween. With a cigarette having a filter composed of cellulose diacetate tow as a control sample, smoking tests were conducted in a cigarette smoking machine under standard smoking conditions, and constituents in cigarette mainstream smoke were tested according to related test standards, and the results are shown in Table 8 and Table 9.

TABLE 8

Performance evaluation of cigarette sample including cellulose diacetate particle aggregate (60 mg/cig)

| | Pressure drop, kPa | TPM, mg | Tar, mg | Nicotine, mg | CO, mg |
|---|---|---|---|---|---|
| Control sample | 1.20 | 8.99 | 7.34 | 0.65 | 9.42 |
| Sample including particle aggregate | 1.16 | 6.36 | 5.09 | 0.44 | 9.61 |
| Reduction percentage, % | | 29.3 | 30.6 | 31.5 | −2.0 |

TABLE 9

Analysis results of ingredients in cigarette mainstream smoke per cigarette

| | Harmful substances | | | | | | | |
|---|---|---|---|---|---|---|---|---|
| Unit | CO mg | Phenol μg | Croton-aldehyde μg | HCN μg | NNK ng | B[α]P ng | $NH_3$ μg | Harm indices H* |
| Xi (2009 Ave) | 14.2 | 17.4 | 18.6 | 146.3 | 5.5 | 10.9 | 8.1 | 10.0 |
| Control sample | 9.4 | 9.9 | 18.5 | 83.5 | 6.3 | 5.5 | 4.3 | 7.1 |
| Sample including particle aggregate | 9.6 | 6.5 | 16.5 | 64.8 | 4.2 | 4.5 | 3.5 | 5.7 |

Example 8

(1) Commercially available cellulose diacetate flakes with an acetyl value of 55.50% were dissolved in acetone, thereby obtaining a homogenous 10.0 wt % cellulose diacetate solution in acetone. With mechanical stirring (250-450 rpm), a 0.2 mol/L ([M]) aqueous NaOH solution (the mass of NaOH is 5.5% of the mass of cellulose diacetate) was added thereto dropwise. As the NaOH solution was added, the cellulose acetate in the solution began to precipitate. Then, an appropriate amount of deionized water was added thereto to facilitate solidifying the precipitated cellulose acetate particles. After continuous stirring for about 2 h, the resultant was suction filtered, washed with deionized water and then spray dried, thereby obtaining white cellulose acetate particles with an average particle size of 45 μm, an acetyl value of 48.6%, a specific surface area of 2.6 $m^3$/g, an average pore size (BJH adsorption) of 17.4 nm and a bulk density of 0.38 g/mL.

(2) An amount of 250 g of the cellulose diacetate particles obtained by the above precipitation method was weighed, and placed into a spray fluidized bed. A binder spray liquid was prepared containing 3 wt % of hydroxypropylmethylcellulose as the binder suspended in water as a medium. An amount of 225 g of the binder spray liquid were sprayed from the top for fluidized granulation under fluidization conditions including an atomization pressure of 60 bar, a spray liquid flow rate of 20 g/min, an air supply rate of 50 $m^3$/h, and an inlet temperature of 50° C. The binder was used at an amount of 2.7% of the mass of the cellulose diacetate particles (i.e., the binder is 6.75 g).

Figure 4:
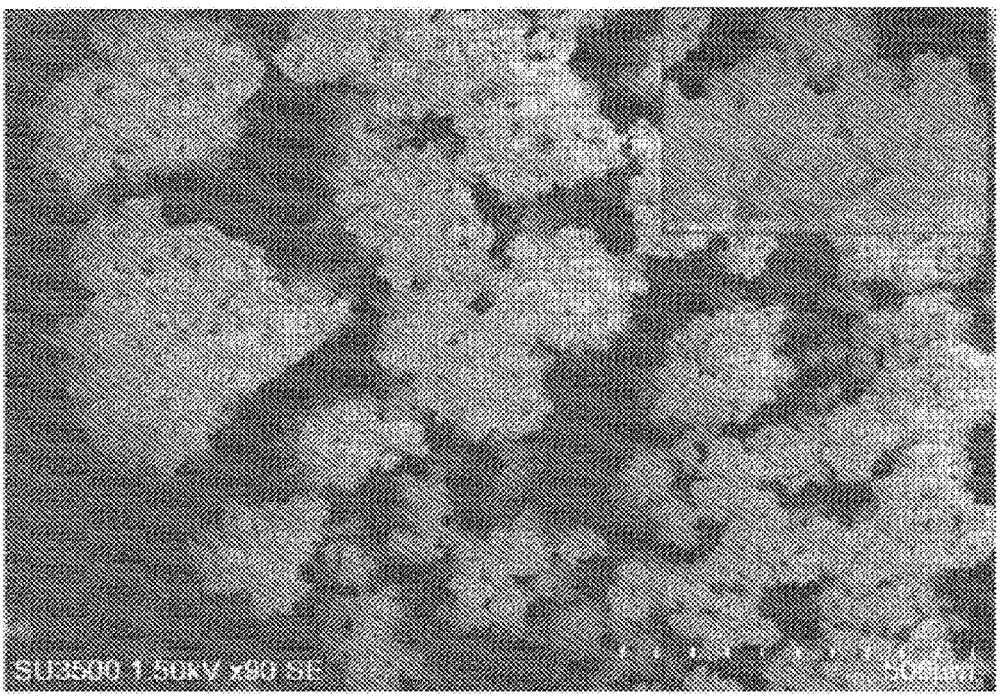
FIG. 4 is an electron micrograph of a cellulose acetate particle aggregate of Example 8 of the present invention.

(3) After the granulation was completed, the finished products were sieved, thereby obtaining a sample of 150-425 μm (i.e., cellulose acetate particle aggregate). As analyzed by an electron microscope, the cellulose acetate particle aggregate was a porous and irregular particle aggregate with a rough and uneven surface formed from spherical particles bound together by the binder (as shown in FIG. 4). The particle aggregate has a specific surface area of 0.72 $m^2$/g and a bulk density of 0.18 g/mL. A portion of the 150-425 μm aggregate was again sieved with a screen mesh, separating into two samples with particle size distribution ranges of 150-300 μm and 300-425 μm, respectively, and having bulk densities of 0.18 g/mL and 0.15 g/mL, respectively.

A composite filter for cigarette was prepared using the aforesaid cellulose acetate particle aggregate as a filtering material. The composite filter was composed of two sections of cellulose diacetate tow rods, of which, one was to be in contact with a smoker's mouth and the other joined with a cigarette, and the cellulose acetate particle aggregate (55 mg) was disposed therebetween. With a cigarette having a filter composed of cellulose diacetate tow as a control sample, smoking tests were conducted in a cigarette smoking machine under standard smoking conditions, and constituents in cigarette mainstream smoke were tested according to related test standards, and the results are shown in Table 10.

TABLE 10

Performance evaluation of cigarette sample including cellulose diacetate particle aggregate (55 mg/cig)

| | Pressure drop, kPa | TPM, mg | Tar, mg | Nicotine, mg | Phenol, μg |
|---|---|---|---|---|---|
| Control sample | 1.18 | 15.19 | 11.68 | 0.97 | 14.44 |
| Sample including particle aggregate (150-425 μm) | 1.16 | 12.02 | 9.54 | 0.75 | 10.10 |
| Reduction percentage, % | | 20.8 | 18.3 | 22.5 | 30.1 |
| Sample including particle aggregate (150-300 μm) | 1.18 | 12.45 | / | / | 8.58 |
| Reduction percentage, % | | 18.0 | | | 43.6 |
| Sample including particle aggregate (300-425 μm) | 1.13 | 14.72 | / | / | 12.47 |
| Reduction percentage, % | | 3.1 | | | 13.6 |

Example 9

(1) Commercially available cellulose triacetate flakes with an acetyl value of 61.20% were dissolved in acetone/dimethyl sulfoxide (the ratio by mass of acetone to dimethyl sulfoxide is 4:1) as a solvent, thereby obtaining 3000 g of a homogenous 10.1 wt % cellulose triacetate solution. With mechanical stirring (250-450 rpm), 860 g of a water/acetone solution containing 7.2 g of NaOH (the ratio by mass of acetone to water is 5:1, the mass of NaOH is 2.4% of the mass of cellulose triacetate) was added dropwise into the cellulose triacetate solution, followed by addition of 2300 g of deionized water to precipitate and solidify the cellulose acetate. After continuous stirring for about 4 hours, the resultant was suction filtered, washed with deionized water and then spray dried, thereby obtaining white cellulose acetate particles with an average particle size of 44 μm, an acetyl value of 59.5%, a specific surface area of 11.1 $m^3/g$, an average pore size (BJH adsorption) of 18.2 nm and a bulk density of 0.36 g/mL.

(2) An amount of 250 g of the aforesaid cellulose acetate particles obtained by the above precipitation method was weighed, and placed into a spray fluidized bed. A binder suspension, which was prepared with 3% hydroxypropylmethylcellulose as the binder and water as a medium, was sprayed from the top for fluidized granulation under fluidization conditions including an atomization pressure of 60 bar, a spray liquid flow rate of 20 g/min, an air supply rate of 45 $m^3/h$, and an inlet temperature of 50° C. 342 g of the binder solution was used, and the mass of the binder is 4.1% of the mass of the cellulose triacetate particles (i.e., the binder is 10.25 g).

Figure 5:
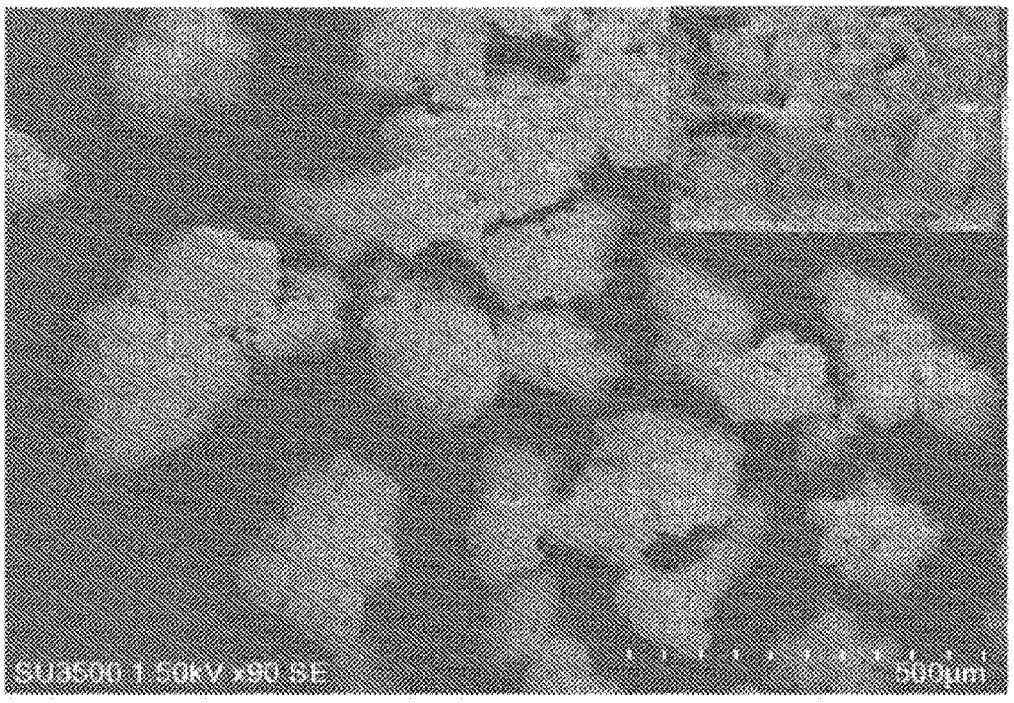
FIG. 5 is an electron micrograph of a cellulose acetate particle aggregate of Example 9 of the present invention.

(3) After the granulation was completed, the finished products were sieved, thereby obtaining a sample of 150-425 μm (i.e., cellulose acetate particle aggregate). As analyzed by an electron microscope, the cellulose acetate particle aggregate was a porous and irregular particle aggregate with a rough and uneven surface formed from the cellulose acetate particles bound together by the binder (as shown in FIG. 5). The particle aggregate had a specific surface area of 3.4 $m^2/g$ and a bulk density of 0.18 g/mL. Part of the 150-425 μm aggregate was additionally sieved with a screen mesh, obtaining samples with a distribution interval of 150-300 μm and 300-425 μm respectively, their bulk density being 0.19 g/mL and 0.16 g/mL respectively.

A composite filter for cigarette was prepared using the aforesaid cellulose acetate particle aggregate as a filtering material. The composite filter was composed of two sections of cellulose triacetate tow rods, of which, one was to be in contact with a smoker's mouth and the other joined with a cigarette, and the cellulose acetate particle aggregate (55 mg) was disposed therebetween. With a cigarette having a filter composed of cellulose triacetate tow as a control sample, smoking tests were conducted in a cigarette smoking machine under standard smoking conditions, and constituents in cigarette mainstream smoke were tested according to related test standards, and the results are shown in Table 11.

TABLE 11

Performance evaluation of cigarette sample including cellulose triacetate particle aggregate (55 mg/cig)

| | Puff and inhalation resistance, kPa | TPM, mg | Tar, mg | Nicotine, mg | Phenol, μg |
|---|---|---|---|---|---|
| Control sample | 1.18 | 14.50 | 11.50 | 0.94 | 14.44 |
| Sample including particle aggregate (150-425 μm) | 1.16 | 12.33 | 10.07 | 0.83 | 9.34 |
| Reduction percentage, % | | 15.0 | 12.5 | 11.8 | 35.3 |
| Sample including particle aggregate (150-300 μm) | 1.20 | 11.76 | / | / | 9.08 |
| Reduction percentage, % | | 18.9 | | | 37.1 |
| Sample including particle aggregate (300-425 μm) | 1.12 | 13.11 | / | / | 11.58 |
| Reduction percentage, % | | 9.6 | | | 19.8 |

Example 10

(1) A sample (270 g) of freeze-ground cellulose acetate particles (with an average particle size of 51 μm) was dispersed and immersed into a 10 wt % acetone/water solution. Then, a 50% NaOH solution (27 g, the mass of NaOH is 5.0% of the mass of the cellulose acetate particles) was added thereto. The resulting mixture was stirred for 2 hours, and then filtered, washed with water, and spray dried to obtain cellulose acetate particles with an acetyl value of 49.5%.

(2) A sample (250 g) of the aforesaid spray-dried cellulose acetate particles were weighed, and placed into a spray fluidized bed. A binder spray liquid was prepared using hydroxypropylmethylcellulose (2.9 wt %) and triethyl citrate (3.3 wt %) in water. An amount of 182 g of the spray liquid was sprayed from the top of the fluidized bed under fluidization conditions including an atomization pressure of 60 bar, a spray liquid flow rate of 20 g/min, an air supply rate of 45 $m^3/h$, and an inlet temperature of 50° C. The binder is 2.1% of the mass of the cellulose diacetate particles (i.e., the binder is 5.28 g).

Figure 6:
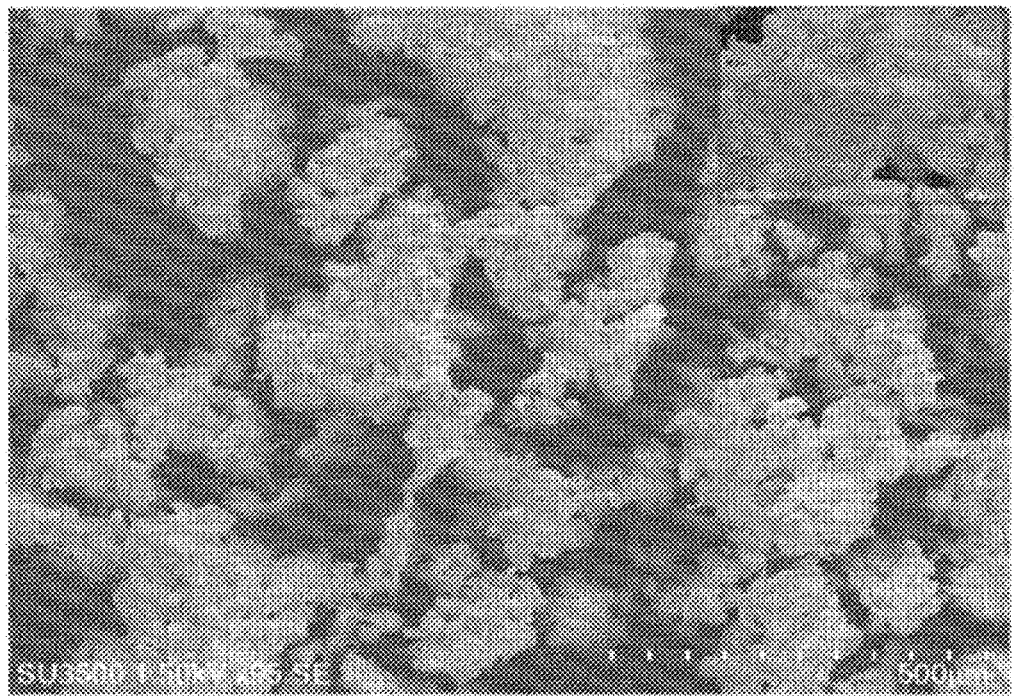
FIG. 6 is an electron micrograph of a cellulose acetate particle aggregate of Example 10 of the present invention.
Figure 7:
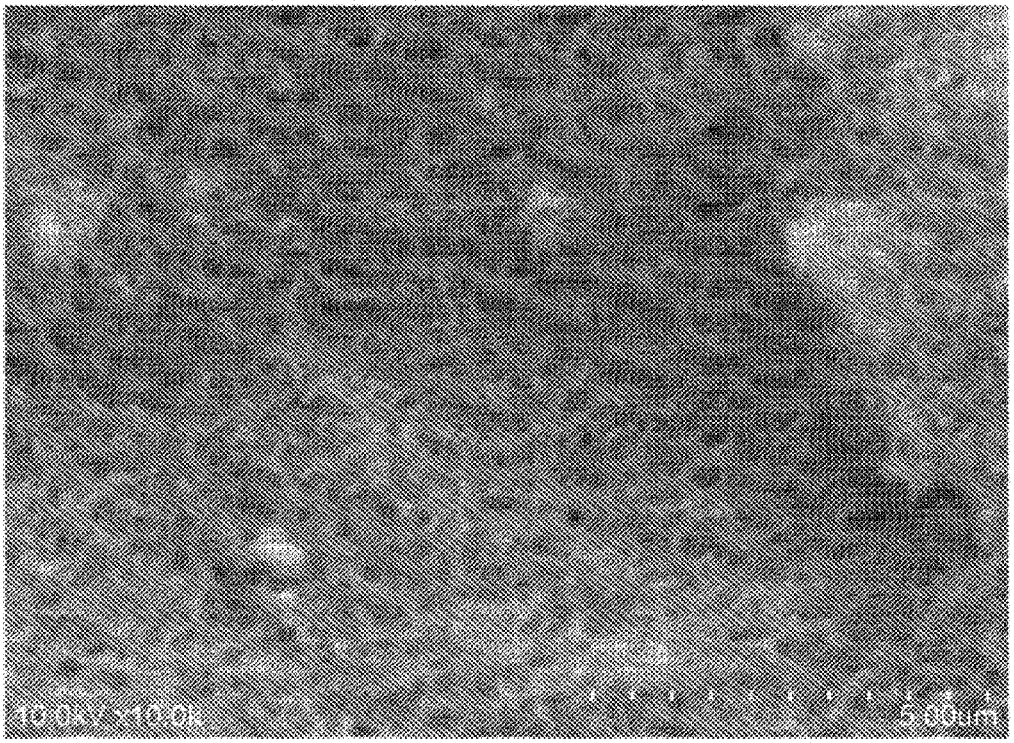
FIG. 7 is an electron micrograph of a particle of Comparative Example 1 of the present invention.

(3) After the granulation was completed, the finished products were sieved, thereby obtaining a sample of 150-425 μm (i.e., cellulose acetate particle aggregate) with a bulk density of 0.19 g/mL. As analyzed by an electron microscope, the cellulose acetate particle aggregate was porous and irregular, with a rough and uneven surface (as shown in FIG. 6).

A composite filter for cigarette was prepared using the aforesaid cellulose acetate particle aggregate as a filtering material. The composite filter was composed of two sections of cellulose diacetate tow rods, of which, one was to be in contact with a smoker's mouth and the other joined with a cigarette, and the cellulose acetate particle aggregate (60 mg) was disposed therebetween. With a cigarette having a filter composed of cellulose diacetate tow as a control sample, smoking tests were conducted in a cigarette smoking machine under standard smoking conditions, and constituents in the cigarette mainstream smoke were tested according to related test standards, and the results are shown in Table 12.

TABLE 12

Performance evaluation of cigarette sample including cellulose diacetate particle aggregate (60 mg/cig)

| | Pressure drop, kPa | TPM, mg | Phenol, μg |
|---|---|---|---|
| Control sample | 1.18 | 15.06 | 14.49 |
| Sample including particle aggregate | 1.22 | 12.59 | 10.41 |
| Reduction percentage, % | | 16.4 | 28.2 |

Example 11

(1) Commercially available cellulose diacetate flakes with an acetyl value of 55.50% were ground in a basket-type grinder with water as a medium. The suspension of ground cellulose diacetate in water was dried through centrifugal spray, thereby obtaining cellulose diacetate particles with an average particle size of 50 μm, a specific surface area of 5.2 $m^2/g$, and a bulk density of 0.22 g/mL.

(2) A sample (250 g) of the aforesaid spray-dried cellulose diacetate particles were weighed, placed into a spray fluidized bed. A binder spray liquid was prepared using 4.5% ethylcellulosein absolute ethyl alcohol. An amount of 447 g of the binder spray liquid (containing 20.115 g of the binder) was sprayed from the top of the fluidized bed under fluidization conditions including an atomization pressure of 60 bar, a spray liquid flow rate of 25 g/min, an air supply rate of 40 $m^3/h$, and an inlet temperature of 50° C. The binder is 8.05% of the mass of the cellulose diacetate particle aggregate. After the binder was applied, the fluidized bed was maintained at an air inlet temperature of 60° C. and an air supply rate of 30 $m^3/h$ for 10 minutes.

(3) After the granulation was completed, the finished products were sieved, thereby obtaining a sample of 150-850 μm (i.e., cellulose acetate particle aggregate). As analyzed by an electron microscope, the cellulose acetate particle aggregate was porous and irregular with a rough and uneven surface, a pore size of 1-15 μm, a specific surface area of 3.9 $m^2/g$, and a bulk density of 0.09 g/mL.

A composite filter for cigarette was prepared using the aforesaid cellulose acetate particle aggregate as a filtering material. The composite filter was composed of two sections of cellulose diacetate tow rods, of which, one was to be in contact with a smoker's mouth and the other joined with a cigarette, and the cellulose acetate particle aggregate (60 mg) was disposed therebetween. With a cigarette having a filter composed of cellulose diacetate tow as a control sample, smoking tests were conducted in a cigarette smoking machine under standard smoking conditions, and constituents in the cigarette mainstream smoke were tested according to related test standards, and the results are shown in Table 13. A portion of the 150-850 μm aggregate was again sieved with a screen mesh, obtaining two samples with particle size distribution ranges of 150-425 μm and 425-850 μm, respectively, and bulk densities of 0.07 g/mL and 0.09 g/mL, respectively.

TABLE 13

Performance evaluation of cigarette sample including cellulose diacetate particle aggregate

| | Pressure drop, kPa | TPM, mg |
|---|---|---|
| Control sample | 1.18 | 14.73 |
| Sample including particle aggregate (150-425 μm) | 1.22 | 11.36 |
| Reduction percentage, % | | 22.9 |
| Sample including particle aggregate (150-850 μm) | 1.19 | 11.29 |
| Reduction percentage, % | | 23.4 |
| Sample including particle aggregate (425-850 μm) | 1.20 | 12.11 |
| Reduction percentage, % | | 17.8 |

COMPARATIVE EXAMPLES

Currently, pressure drop during puff and inhalation of cigarettes is controlled within 1.0-1.2 kPa. While ensuring pressure drops being substantially identical to the pressure drops of the cigarettes with filters comprised of the porous cellulose diacetate particle aggregates of the present invention, the following particles were tested, as comparisons, for their filtering performance for cigarette smoke. The test results are shown in Table 14.

Comparative Example 1

A particle made by precipitation with a particle size in a range of 150-425 μm. As analyzed by scanning electron microscopy, the particle had a reticular porous surface, with pore sizes mostly in the range of 0.1-0.3 μm, and a bulk density of 0.29 g/mL. As shown by BET analysis, its specific surface area was up to 45.2 $m^2/g$.

Comparative Example 2

Cellulose diacetate flakes were mechanically pulverized and sieved, providing particles with sizes in a range of 150-425 μm. The particles had a specific surface area of 4.5 $m^2/g$ and a bulk density of 0.23 g/mL.

Comparative Example 3

Figure 8:
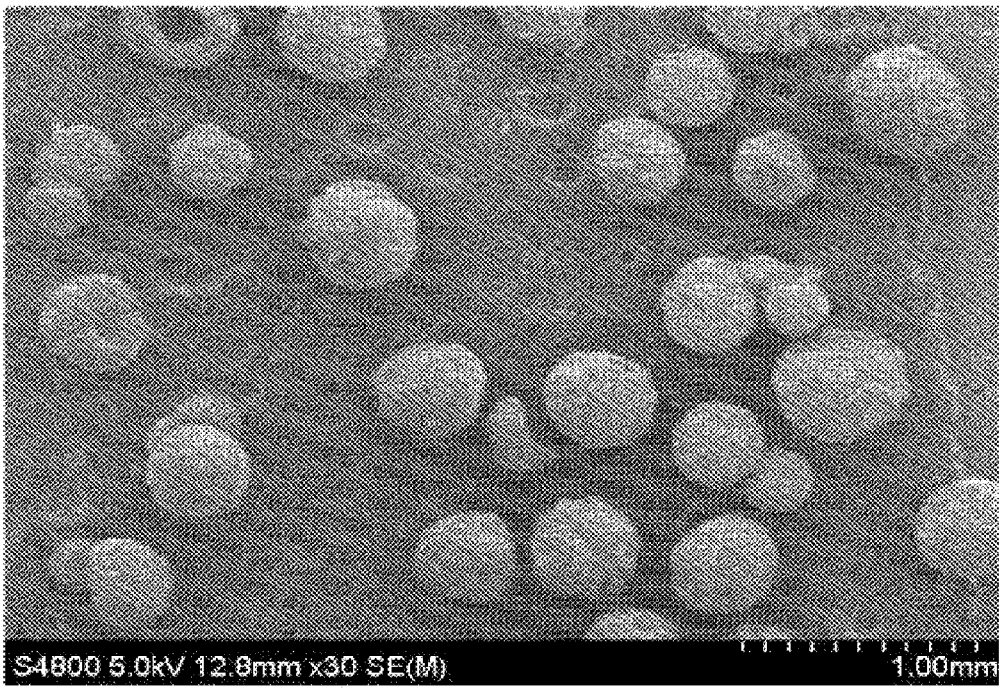
FIG. 8 is an electron micrograph of a particle of Comparative Example 3 of the present invention.
Figure 9:
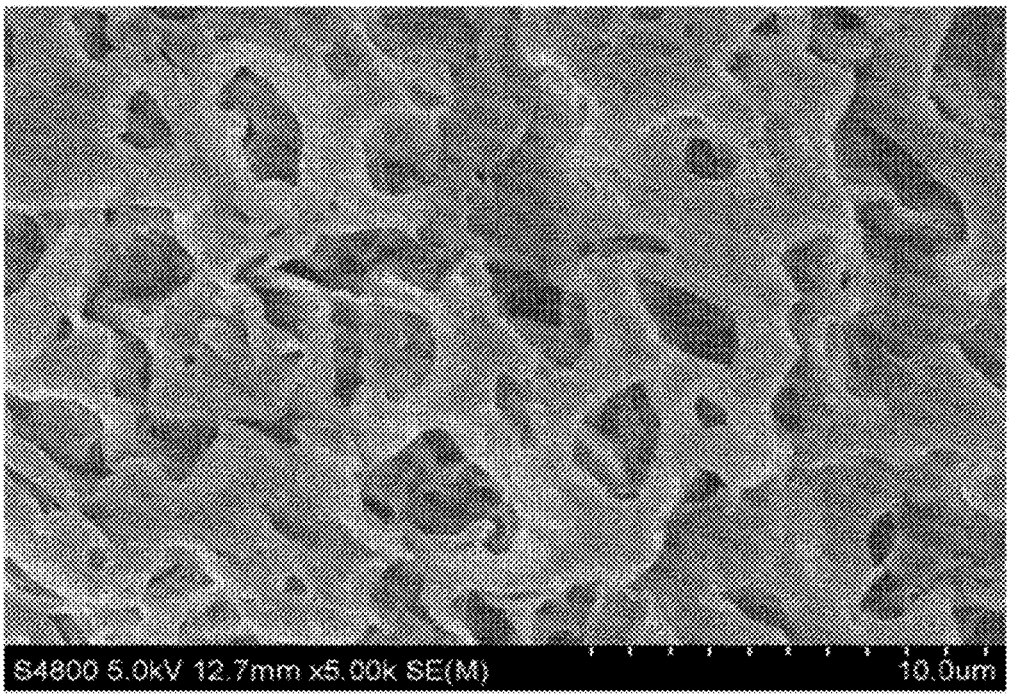
FIG. 9 is another electron micrograph of the particle of Comparative Example 3 of the present invention.

A particle prepared by a double emulsion method (W/OW), having particle sizes in a range of 150-425 μm, a specific surface area of 18.3 $m^2/g$, and a bulk density of 0.32 g/mL. As analyzed by scanning electron microscopy, the particles were porous on the surface with pore sizes in a range of 0.2-1.5 μm (as shown in FIG. 8 and FIG. 9).

Comparative Example 4

The particles prepared in the step 1 in Example 1 of the present invention, which had an average particle size of 50 μm, a specific surface area of 5.2 $m^2/g$, and a bulk density of 0.22 g/mL. A composite filter for cigarette was prepared using 60 mg/cig of this particle. The composite filter was composed of two sections of cellulose diacetate tow rods, of which, one was to be in contact with a smoker's mouth and the other joined with a cigarette, and the cellulose acetate particles were disposed therebetween. A cigarette with this composite filter had a pressure drop of 5.4 kPa, much higher than the currently required range of cigarette pressure drop. Thus, this particle had no commercial value.

Comparative Example 5

The particles prepared in the step 1 in Example 8 of the present invention, which had an average particle size of 30 μm, a specific surface area of 2.6 $m^2/g$, and a bulk density of 0.38 g/mL. A composite filter for cigarette was prepared using 60 mg/cig of this particle. The composite filter was composed of two sections of cellulose diacetate tow rods, of which, one was to be in contact with a smoker's mouth and the other joined with a cigarette, and the cellulose acetate particles were disposed therebetween. A cigarette with this composite filter had a pressure drop of 9.43 kPa, much higher than the currently required range of cigarette pressure drop. Thus, this particle had no commercial value.

The results in Table 14 show that the filter rod comprising the porous cellulose acetate particle aggregate of the present invention has a filtering efficiency for total particular matters in cigarette smoke much higher than that of the filter rods comprising the particles of Comparative Examples 1, 2 and 3.

TABLE 14

Smoke filtering performance evaluation of cigarette samples including different particles

| | Pressure drop, kPa | TPM, mg | Tar, mg | Nicotine, mg |
|---|---|---|---|---|
| Control sample | 1.20 | 8.95 | 7.68 | 0.64 |
| Sample with the particle aggregate (Example 1) | 1.25 | 6.24 | 5.50 | 0.45 |
| Reduction percentage, % | | 30.3 | 28.4 | 29.7 |
| First comparative particle | 1.23 | 8.87 | 7.54 | 0.66 |
| Reduction percentage, % | | 0.89 | 1.8 | −3.1 |
| Control sample | 1.18 | 8.84 | 7.58 | 0.60 |
| Second comparative particle | 1.20 | 8.13 | 7.12 | 0.56 |
| Reduction percentage, % | | 8.7 | 6.1 | 6.7 |
| Control sample | 1.18 | 8.92 | 7.72 | 0.65 |
| Third comparative particle | 1.18 | 8.56 | 7.39 | 0.62 |
| Reduction percentage, % | | 4.0 | 4.3 | 4.6 |

The above descriptions of the embodiments are provided so that those of ordinary skill in the art can understand and use the present invention. Obviously, those of skilled in the art can readily make various modifications to these embodiments and apply the general principle described herein to other embodiments without creative work. Therefore, the present invention is not limited to the above embodiments. All the modifications and alterations made by those skilled in the art according to the present invention without departing the scope of the present invention should be covered within the protective scope of the present invention.

What is claimed:

1. A method for preparing a cellulose acetate particle aggregate, comprising:

(a) selecting cellulose acetate particles and a second kind of particles in a select ratio, or the cellulose acetate particles alone;

(b) adding a binder thereto to prepare particle aggregates by an air fluidized granulation method; and (c) sieving the particle aggregates to obtain a cellulose acetate particle aggregate with a desired particle size;

wherein:

the preparation method yields a cellulose acetate particle aggregate comprising 49-99.5 wt % of the cellulose acetate particles, 0-50 wt % of the second kind of particles and 0.5-20 wt % of the binder;

the cellulose acetate particles are obtained by:

dissolving cellulose acetate in an organic solvent to obtain a cellulose acetate solution of a select concentration;

with mechanical stirring at 250-450 rpm, adding an aqueous NaOH solution dropwise to the cellulose acetate solution to precipitate the cellulose acetate to obtain a white suspension;

further stirring the suspension for a period of time to solidify the particles precipitated from the suspension; and suction filtering the suspension, washing the filtered particles with water and then drying the particles by centrifugal spray, thereby obtaining the cellulose acetate particles; and the organic solvent is acetone or a mixture of acetone and dimethyl sulfoxide, the acetyl value of the cellulose acetate is in the range of 40-62%, and the concentration of the aqueous NaOH solution is 0.05-1.0 mol/L.

2. The method of claim 1, further comprising grinding particle aggregates sieved out for having particle sizes larger than an upper limit of the desired range of particle size to be used in step (a).

3. The method of claim 1, further comprising directly using the particle aggregates sieved out for having particle sizes smaller than a lower limit of the desired range of particle size in step (a).

4. The method of claim 1, wherein the method is a continuous type or a batch type.

5. The method of claim 1, wherein the acetyl value of the cellulose acetate is in the range of 45-60%, and the concentration of the aqueous NaOH solution is 0.1-1.0 mol/L.

6. The method of claim 1, wherein the air fluidized granulation method comprises steps of:

stirring the binder in a solvent to prepare a binder spray liquid;

atomizing and spraying the binder spray liquid; and maintaining the cellulose acetate particles and the second kind of particles or the cellulose acetate particles alone in a fluidized state in the fluidized bed by feeding air from a bottom to contact and bind with the binder spray liquid, and then drying the resultant to obtain the particle aggregate.

7. The method of claim 6, wherein the solvent is one or more selected from the group consisting of water, ethanol, propanol, and acetone.

8. The method of claim 6, wherein an atomization pressure is in a range of 50-120 bars, and a spray flow rate of the binder spray liquid is in a range of 10-30 g/min.

9. The method of claim 6, wherein a supply rate of air from the bottom is in a range of 20-80 $m^3$/hour, and the inlet temperature of air from the bottom is in a range of 20-55° C.

* * * * *